US008276907B2

(12) United States Patent
Shiohara et al.

(10) Patent No.: US 8,276,907 B2
(45) Date of Patent: Oct. 2, 2012

(54) RECORDING APPARATUS

(75) Inventors: Hiroshi Shiohara, Shiojiri (JP); Munetoyo Aono, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 518 days.

(21) Appl. No.: 12/612,023

(22) Filed: Nov. 4, 2009

(65) Prior Publication Data

US 2010/0111584 A1 May 6, 2010

(30) Foreign Application Priority Data

Nov. 5, 2008 (JP) ..... 2008-284581

(51) Int. Cl.
*B65H 31/00* (2006.01)

(52) U.S. Cl. ..... 271/207; 271/224; 400/625; 399/405

(58) Field of Classification Search ..... 271/207, 271/213, 224; 400/647.1, 625; 399/405
See application file for complete search history.

(56) References Cited

U.S. PATENT DOCUMENTS

| | | | | |
|---|---|---|---|---|
| 5,046,716 | A * | 9/1991 | Lippold | 271/214 |
| 6,568,865 | B1 * | 5/2003 | Fujioka et al. | 400/647.1 |
| 6,595,514 | B2 * | 7/2003 | Takahashi | 271/162 |
| 7,121,543 | B2 * | 10/2006 | Fujioka | 271/207 |
| 7,621,527 | B2 * | 11/2009 | Van Gerven et al. | 271/207 |
| 7,997,578 | B2 * | 8/2011 | Saito et al. | 271/213 |
| 2002/0105136 | A1 * | 8/2002 | Ries | 271/207 |
| 2002/0140161 | A1 * | 10/2002 | Ries et al. | 271/207 |
| 2003/0146565 | A1 * | 8/2003 | Fujioka | 271/207 |
| 2005/0280202 | A1 * | 12/2005 | Vila et al. | 271/213 |
| 2006/0181008 | A1 * | 8/2006 | Van Gerven et al. | 271/207 |
| 2009/0127770 | A1 * | 5/2009 | Tamaki | 271/207 |

FOREIGN PATENT DOCUMENTS

JP 2001-328762 11/2001

* cited by examiner

*Primary Examiner* — Kaitlin Joerger
(74) *Attorney, Agent, or Firm* — Workman Nydegger

(57) ABSTRACT

A recording apparatus includes: a recording unit that performs a recording operation on a sent recording medium; a main body that has the recording unit; a discharge stacker that places the recording medium discharged from the main body therein; and a flexible member that forms a lateral closed region by connecting a downstream end in a discharge direction of the discharge stacker and the main body on the upper side of the downstream end in the discharge direction of the discharge stacker in a placing direction.

9 Claims, 9 Drawing Sheets

RECORDING APPARATUS

BACKGROUND

1. Technical Field

The present invention relates to a recording apparatus that includes a recording unit performing a recording operation on a sent recording medium, a main body having the recording unit, and a discharge stacker placing the recording medium discharged from the main body.

The recording apparatus according to the invention includes an ink jet printer, a wire dot printer, a laser printer, a line printer, a copying machine, a facsimile machine, etc.

2. Related Art

Conventionally, as disclosed in JP-A-2001-328762, a recording apparatus includes a delivery unit delivering a sheet-like material and a loading member on which the sheet-like material discharged by the delivery unit is loaded. A chain as a bumping body constituted by a flexible member is suspended from the upper side of the loading member toward the front side of the discharge direction of the sheet-like material of the delivery unit. The tip end of the sheet-like material delivered by the delivered unit is bumped by the chain to drop the sheet-like material on the loading member.

However, when the sheet-like material is delivered powerfully, it may not be sufficiently held by the chain. Accordingly, the sheet-like material may be popped out from the loading member and the tip end of which then may be soiled when comes into contact with a floor, i.e. the installation surface of the recording apparatus.

Meanwhile, there is a conventional structure by which sufficient sheet-like material can be received as illustrated in FIG. 9.

FIG. 9 is a side view schematically illustrating an example of a conventional discharge stacker.

As illustrated in FIG. 9, the discharge stacker 80 has a contact stopper 81 formed by vertically erecting at a downstream end in the discharge direction. Therefore, a tip end of a paper 82 powerfully discharged from a recording unit 83 comes into contact with a contact stopper 81 so that the paper 82 can be stopped. That is, the contact stopper 81 can receive the paper 82.

However, since the paper 82 is discharged powerfully, the tip end of the paper 82 may be damaged, e.g. bent when it comes into contact with the contact stopper 81.

SUMMARY

An advantage of some aspects of the invention is that it provides a recording apparatus that can prevent a discharged recording medium from coming into contact with an installation surface of the apparatus and reduce damage to a tip end of the recording medium.

In order to achieve the above-described object, a recording apparatus according to the first aspect of the invention includes: a recording unit that performs a recording operation on a sent recording medium; a main body that has the recording unit; a discharge stacker that places the recording medium discharged from the main body therein; and a flexible member that forms a lateral closed region by connecting a downstream end in a discharge direction of the discharge stacker and the main body on the upper side of the downstream end in the discharge direction of the discharge stacker in a placing direction.

Here, the "upper side of a placing direction" refers to a side on which the recording medium is placed with respect to the discharge stacker. Further, the "lateral closed region" refers to a region whose discharge direction downstream side is closed.

According to the first aspect of the invention, the flexible member forms a lateral closed region by connecting a downstream end in the discharge direction of the discharge stacker and the main body on the upper side of the downstream end in the discharge direction of the discharge stacker in a placing direction. Therefore, even when the tip end of the discharged recording medium has run off the discharge direction downstream end of the discharge stacker, the tip end of the recording medium is prevented from coming into contact with a surface on which the recording apparatus is installed. That is, even when the recording medium is discharged powerfully, the tip end of the recording medium is prevented from being popped out from the downstream end in the discharge direction of the discharge stacker and coming into contact with the installation surface. As a result, the recording medium is prevented from coming into contact with the installation surface and being damaged.

The tip end of the recording medium that has run off the downstream end in the discharge direction of the discharge stacker can be flexibly received at one end of the flexible member and be guided toward the other end, i.e. the main body. That is, the tip end of the recording medium does not come into contact but is flexibly received while the flexible member is being deformed. Further, when the recording medium is received, the direction of the tip end of the recording medium can be changed to the upper side. As a result, damage to the tip end of the recording medium can be reduced as compared with a conventional contact structure.

According to the second aspect of the invention, a recording apparatus includes: a recording unit that performs a recording operation on a sent recording medium; a main body that has the recording unit; a discharge stacker that places the recording medium discharged from the main body therein; and a flexible member that connects a discharge direction downstream end of the discharge stacker and the main body on the upper side of the discharge direction downstream end of the discharge stacker in a placing direction in a state in which the flexible member is loosened so as not to come into contact with a surface on which the recording apparatus is installed.

According to the second aspect of the invention, a flexible member connects a downstream end in the discharge direction of the discharge stacker and the main body on the upper side of the downstream end in the discharge direction the discharge stacker in a placing direction in a state in which the flexible member is loosened so as not to come into contact with a surface on which the recording apparatus is installed. Therefore, it can achieve the same operation and effect as those of the first aspect of the invention.

The tip end of the powerfully discharged recording medium can be received at one end of the flexible member more flexibly and be guide toward the other end, i.e. the main body by the configuration of the flexible member which connect in a state in which the flexible member is loosened. That is, the time period for which the flexible member is pulled tightly after the tip end of the recording medium comes into contact with the flexible member is lengthened in accordance with the extent of the looseness, thereby distributing the magnitude of a force applied to the tip end of the recording medium. The direction in which the tip end of the recording medium proceeds can be changed to the upper side in a smooth locus in accordance with the extent of the looseness and then the tip end can be received.

According to the third aspect of the invention, a recording apparatus includes: a recording unit that performs a recording operation on a sent recording medium; a main body that has the recording unit; a discharge stacker that places the recording medium discharged from the main body therein; and a flexible member that connects a downstream end in the discharge direction the discharge stacker and the main body on the upper side of the downstream end in the discharge direction of the discharge stacker in a placing direction, wherein as the recording medium is discharged, a tip end of the recording medium that has run off the downstream end in the discharge direction of the discharge stacker comes into contact with the flexible member and is guided toward the main body by the flexible member.

According to the third aspect of the invention, as the recording medium is discharged, a tip end of the recording medium that has run off the downstream end in the discharge direction of the discharge stacker comes into contact with the flexible member and is guided toward the main body by the flexible member. Accordingly, the same operation and effect as in the first aspect of the invention can be obtained.

According to the fourth aspect of the invention, in any one of the first to third aspects of the invention, the discharge stacker pivots about a pivot shaft installed on an upstream side of the downstream end in the discharge direction of the discharge stacker and wherein the discharge stacker has a first position taken during a storage of the recording apparatus and a second position where the recording medium that has been discharged from the main body is placed.

According to the fourth aspect of the invention, in addition to the same operation and effect as any one of the first to third aspects of the invention, the discharge stacker pivots about a pivot shaft installed on an upstream side of the downstream end in the discharge direction of the discharge stacker and wherein the discharge stacker has a first position taken during a storage of the recording apparatus and a second position where the recording medium that has been discharged from the main body is placed. That is, the discharge stacker pivots to a plurality of positions. Even in such a configuration, the flexible member does not obstruct the pivot of the discharge stacker. In addition, even in the first position taken during a storage of the recording apparatus, the flexible member is prevented from being obstructed.

Moreover, in the first position, since the flexible member can be received within the discharge stacker, the recording apparatus has a good appearance.

According to the fifth aspect of the invention, in any one of the first to fourth aspects of the invention, the flexible member is a string-like material.

According to the fifth aspect of the invention, in addition to the same operation and effect as any one of the first to fourth aspect of the invention, the flexible member is a string-like material. Therefore, the flexible member can be easily constituted. Further, the string-like material has a lighter weight than a sheet-like material. Moreover, it is excellent in cost performance.

According to the sixth aspect of the invention, in the fifth aspect of the invention, opposite ends of the string-like material engage with the main body and a middle portion of the string-like material engages with the downstream end in the discharge direction of the discharge stacker at a widthwise middle portion of the downstream end.

According to the sixth aspect of the invention, in addition to the same operation and effect as in the fifth aspect of the invention, opposite ends of the string-like material engage with the main body and a middle portion of the string material engages with the downstream end in the discharge direction of the discharge stacker at a widthwise middle portion of the downstream end. In other words, the string-like material has a V-like shape. Therefore, in the widthwise direction, a recording medium of another size can be coped with. Further, since the tip end of the recording medium can come into contact with the string-like material at two points, the posture of the recording medium is prevented from being unstable. Moreover, the string-like material can be easily constituted by one string-like material. That is, a plurality of string-like materials is unnecessary.

According to the seventh aspect of the invention, in any one of the first to sixth aspects of the invention, the discharge stacker has a first inclined portion that is inclined so as to displace toward the upper side along the placing direction as it goes from an upstream side to a downstream side at the downstream end in the discharge direction of the discharge stacker.

According to the seventh aspect of the invention, in addition to the same operation and effect as any one of the first to sixth aspects of the invention, the discharge stacker has a first inclined portion. Therefore, the tip end of the recording medium makes the entry angle with respect to the flexible member when coming into contact with the flexible member, thereby assisting its guidance to the upper side. As a result, damage to the tip end of the recording medium can be reduced.

According to the eighth aspect of the invention, in any one of the first to seventh aspects of the invention, the discharge stacker is provided at a lower side of the main body in a vertical direction and has a second inclined portion that is inclined so as to displace to a vertically lower side as it goes toward a downstream side in the discharge direction of the discharge stacker between the main body and the discharge stacker.

According to the eighth aspect of the invention, in addition to the same operation and effect as any one of the first to seventh aspects of the invention, the discharge stacker has a second inclined portion. That is, the recording medium powerfully slides from the second inclined portion by its own weight. In such a configuration, since the tip end of the recording medium is apt to run off the discharge direction downstream end of the discharge stacker, the flexible member is particularly effective.

According to the ninth aspect of the invention, in the eight aspect of the invention, the second inclined portion has a first sheet-like member and a plurality of second members extending toward the discharge direction of the recording medium, being disposed in the widthwise direction of the recording medium, and having a frictional coefficient smaller than that of the first member in an upper side of a placing direction of the first member.

According to the ninth aspect of the invention, in addition to the same operation and effect as the eighth aspect of the invention, the second inclined portion has a first member and a second member. That is, the discharged recording medium can be sent toward the discharge direction downstream end more smoothly. In such a configuration, since the tip end of the recording medium is apt to run off the discharge direction downstream end of the discharge stacker further, the flexible member is particularly effective.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the accompanying drawings.

Figure 1:
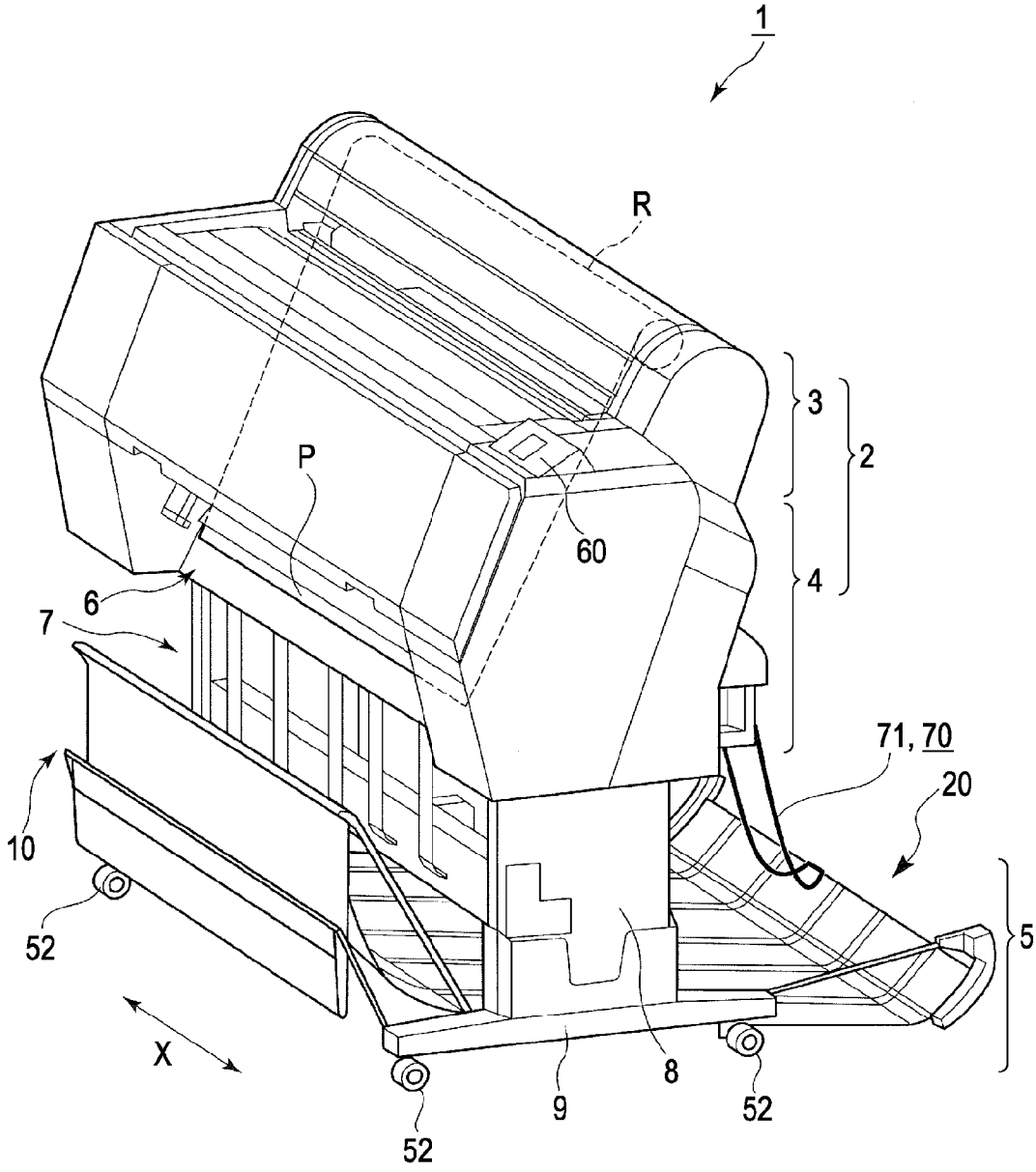
FIG. 1 is a perspective view illustrating the appearance of a printer according to the invention.

FIG. 1 is a perspective view illustrating an appearance of an inkjet printer (hereinafter, referred to as "printer") 1 as an example of a "recording apparatus" or a "liquid ejecting apparatus" according to the invention.

Here, the liquid ejecting apparatus is not limited to an inkjet type recording apparatus that performs a recording operation on a recording medium by ejecting ink on the recording medium such as a recording paper from a recording head as a liquid ejecting head and a recording apparatus such as a copying machine and a facsimile machine, and includes an apparatus that attaches a liquid to a base material corresponding to a recording medium by ejecting a liquid corresponding to a specific purpose instead of ejecting ink from a liquid ejecting head corresponding to the above-described recording head to the base material.

The liquid ejecting head includes a color material ejecting head used for manufacturing of a color filter such as a liquid crystal display, an electrode material (conductive paste) ejecting head used for formation of an electrode of an organic EL display or a field emission display (FED), a bio-organic material ejecting head used for manufacturing of a biochip, and a sample ejecting head that ejects a sample as a precision pipette.

The printer 1 is a large-sized one that can perform a recording operation on an ejected medium having a relatively large size such as A0 or B0 defined by JIS or a roll paper P as a recording medium, and includes a main body 2 having a roll paper supply unit 3 and a recording unit 4, and a discharged paper receiving unit 5.

The main body 2 is provided at an upper portion of a support 8 erected on a base 9, and has a discharge opening 6 through which the roll paper P on which a recording operation has been performed is discharged obliquely downward. An opening 7 of a stacker 10 is located below the discharge opening 6 so that the roll paper P on which the recording operation has been performed is discharged from the discharge opening 6 toward the opening 7 and is received by the stacker 10.

A roll paper roll (hereinafter, referred to as "roll") R is received in the roll paper supply unit 3 so that the roll paper P is continuously sent from the roll R to be supplied obliquely downward to the recording unit 4 that performs a recording operation. The roll R is set to a roll paper holder (not shown). During supply of a roll paper, the roll paper P is supplied to a downstream side by rotating and driving the roll paper holder using a spindle motor (not shown) as a roll driving unit.

The recording unit 4 includes a recording head (not shown) as a liquid ejecting unit or a recorder that discharges (ejects) liquid ink to the roll paper P, a platen (not shown) facing the recording head, a driving transport roller (not shown) installed on an upstream side of the recording head to transport the roll paper P to a downstream side, and a driven transport roller (not shown) driven and rotated by pressing it to the driving transport roller.

The recording head is provided in a carriage (not shown), and the carriage is moved in a main scanning direction X of the recording head by the power of a motor (not shown) while being guided by a guide shaft (not shown) extending in the main scanning direction X of the recording head and a guide plate (not shown) extending in the main scanning direction X.

An air suction unit (not shown) as a paper suction unit is provided on a downstream side of the recording head so that the roll paper P cannot be floated on the downstream side of the recording head by the existence of the air suction unit (not shown) in a restricted state, thereby preventing recording quality from being deteriorated by the floating of the roll paper P.

A manipulation unit 60 manipulated by the user is provided on the front side of the printer 1.

Moreover, a rear stack 20 is provided on the rear side of the printer 1. The rear stack 20 is used when a recording operation is performed on a paper P having a length of not less than B0. The rear stack 20 protrudes toward the rear side of the printer main body 2 in order to secure a placing length in a used state.

Four casters 52 and 52 . . . whose directions can be freely changed are provided below the base 9.

In addition, a string 71 that is an example of a flexible member connecting a stack tip end 24, i.e. a downstream end in the discharge direction in the rear stack 20 and the main body 2 is provided as a paper projection preventing unit 70.

Hereinafter, the rear stack 20 will be described.

Figure 2:
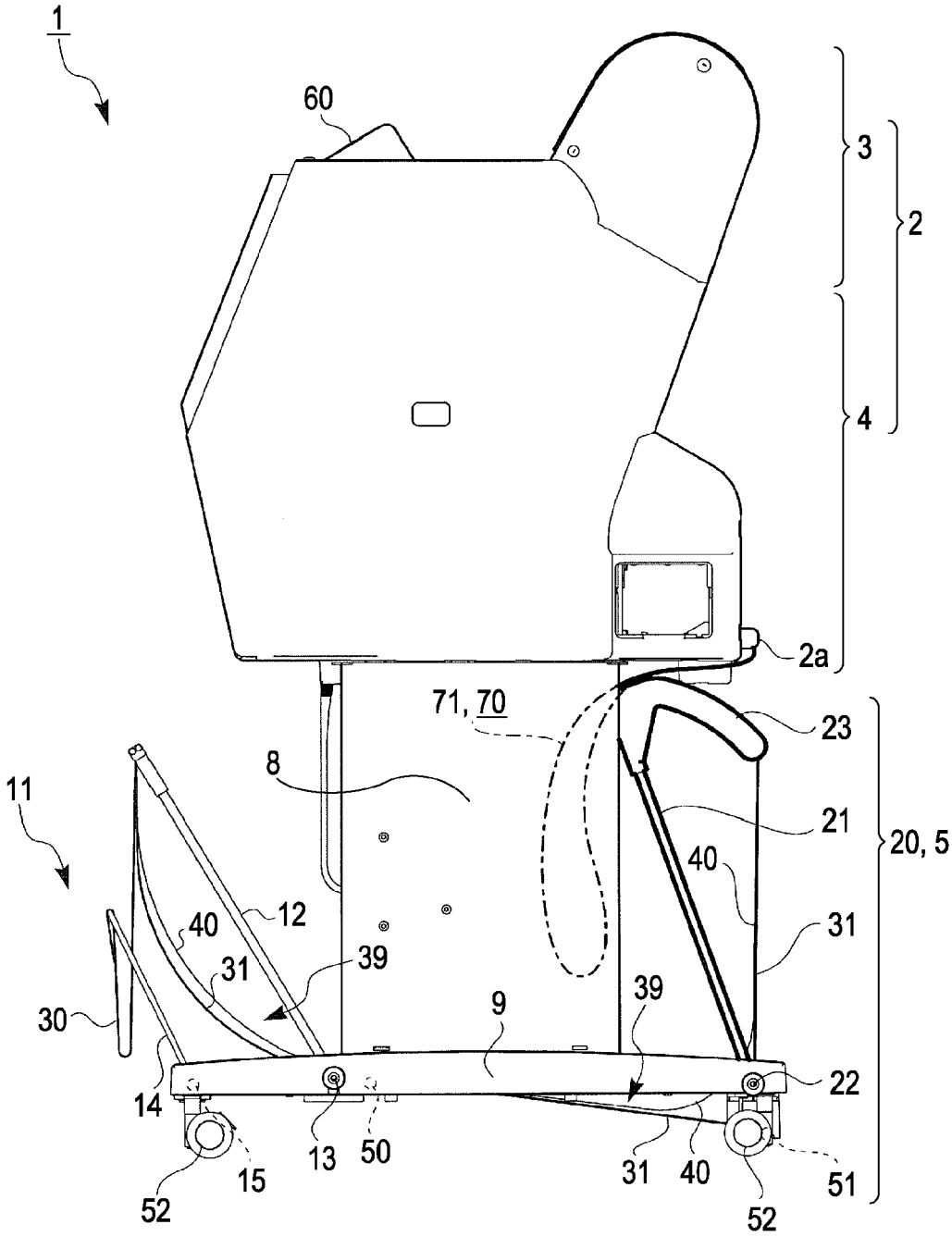
FIG. 2 is a side view (received position of a rear stack) of the printer according to the invention.
Figure 3:
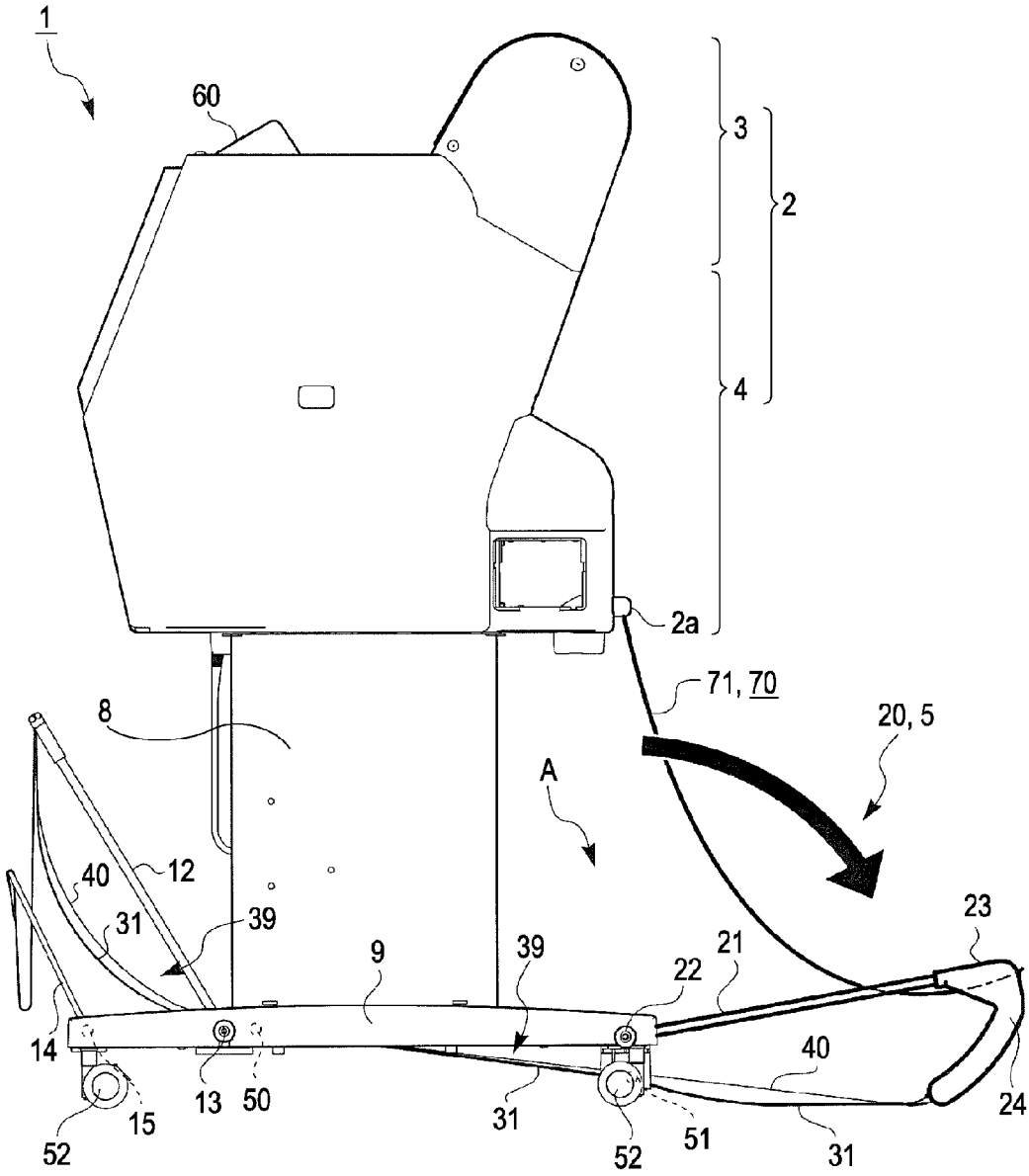
FIG. 3 is a side view (used position of the rear stack) of the printer according to the invention.

FIG. 2 is a side view illustrating the printer when the rear stack according to the invention is in a received position (first position). FIG. 3 is a side view illustrating the printer when the rear stack according to the invention is in a used position (second position).

Figure 4:
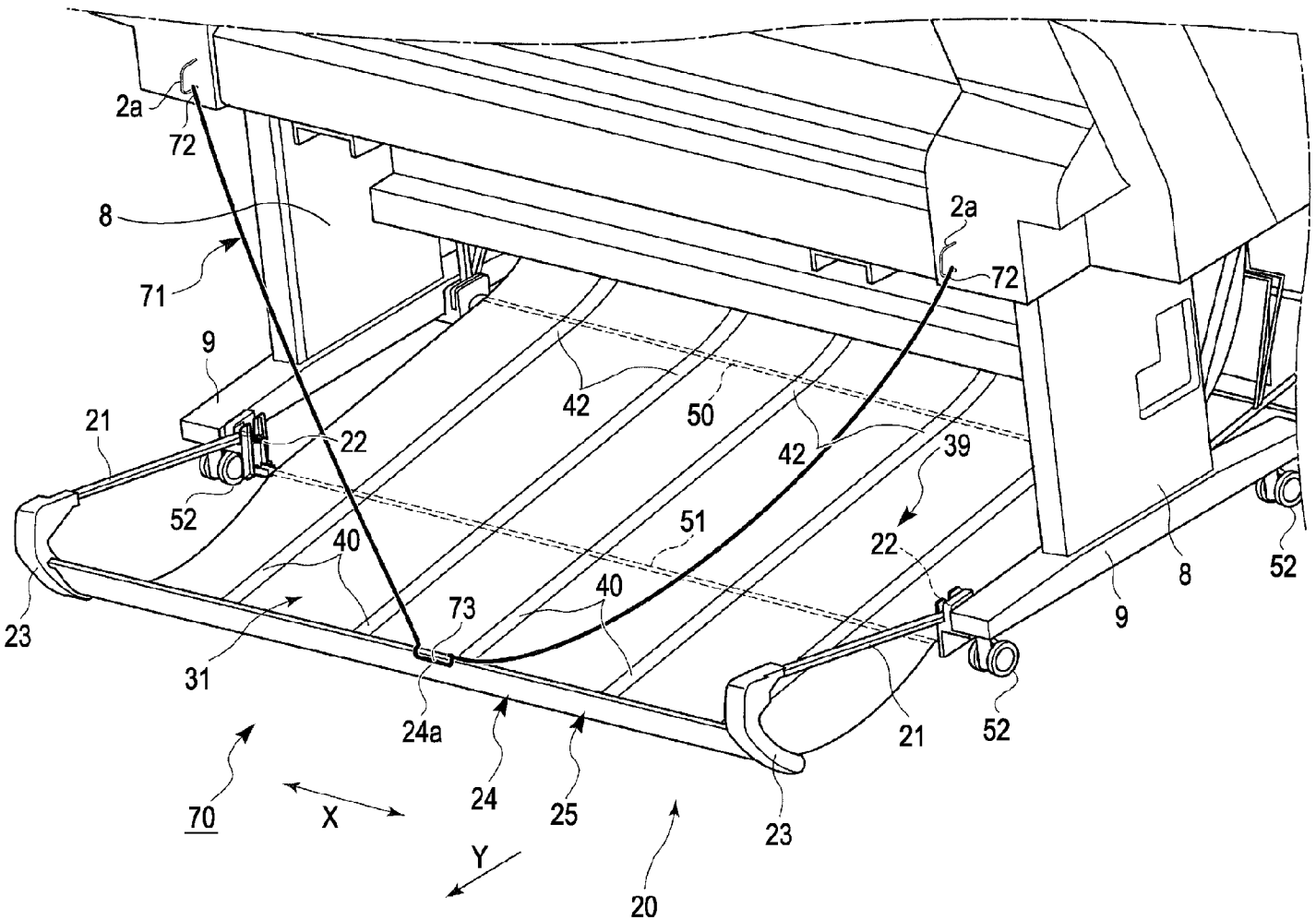
FIG. 4 is an enlarged rear side perspective view illustrating the rear stack in a used state.
Figure 5:
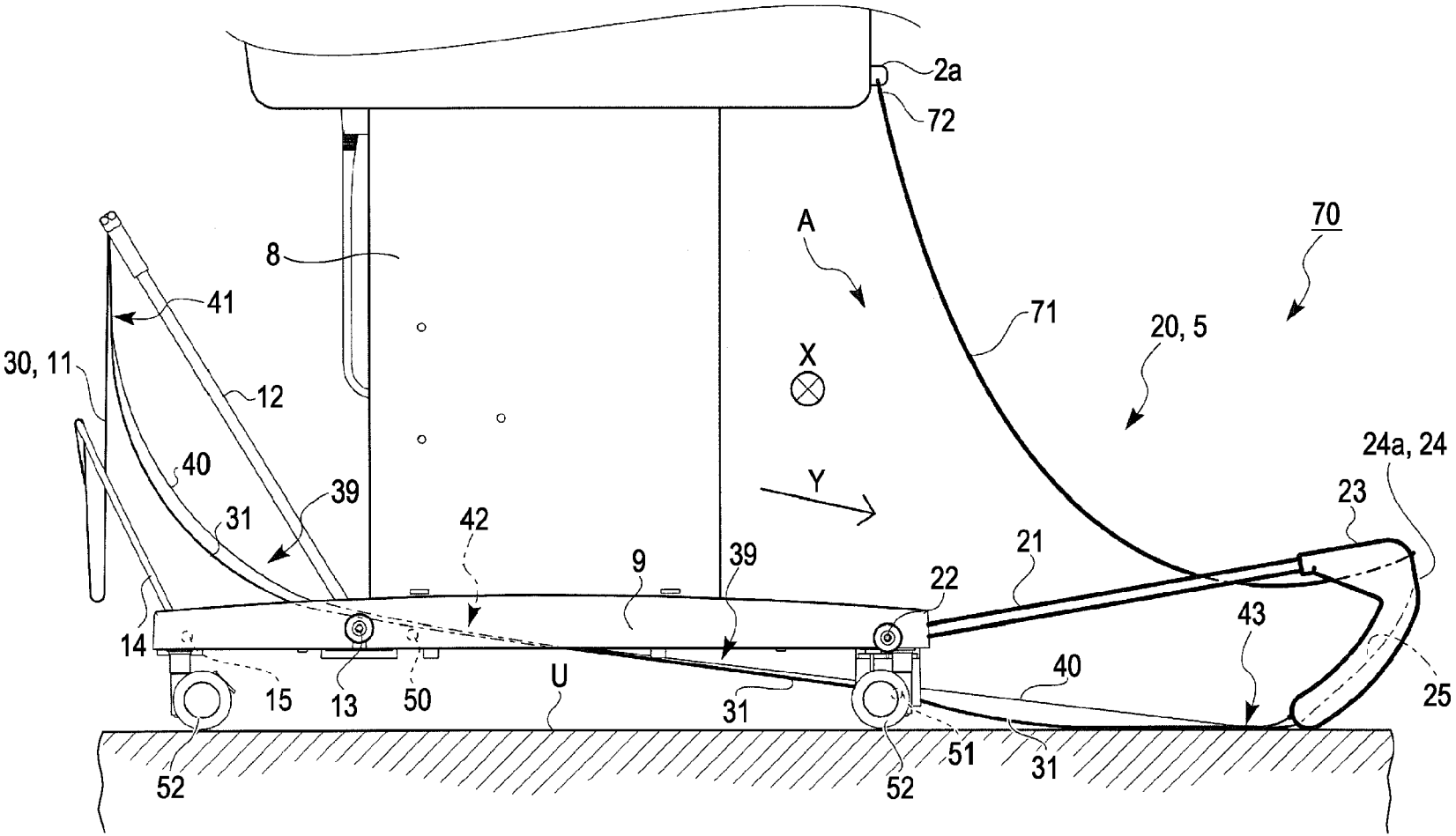
FIG. 5 is a side view of FIG. 4.

FIG. 4 is an enlarged rear side perspective view illustrating the rear stack in a used state. FIG. 5 is a side view of FIG. 4.

As illustrated in FIGS. 2 and 3, the stacker 10 below the printer 1 has a front stack 11 and a rear stack 20, assuming that the manipulation unit 60 is located on the front side.

The front stack 11 has front pipes 12 and 12, a first fabric sheet 30, and arms 14 and 14. A pair of front pipes 12 and 12 and a pair of arms 14 and 14 are provided in the widthwise direction X of the paper P respectively. The pair of front pipes 12 and 12 is swingable about a first pivot shaft 13 provided in the base 9. Likewise, the pair of arms 14 and 14 are swingable about an arm pivot shaft 15 provided in the base 9.

Therefore, the first fabric sheet 30 can be pulled tightly by swinging the pair of front pipes 12 and 12 to the rear side and swinging the pair of arms 14 and 14 to the front side. In this state, the paper P discharged from the opening 7 can be guided and discharged to the front side.

Meanwhile, the first fabric sheet 30 can be loosened by swinging the pair of front pipes 12 and 12 to the front side. The second fabric sheet 31 may be located right below the opening 7.

Therefore, in this state, the paper P discharged from the opening 7 can be guided to the rear side, i.e. the rear stack 20.

Here, a second inclined portion 39 displaced and inclined to a vertically lower side as it goes toward a downstream side in the discharge direction is provided in a discharge path extending from the right lower side of the opening 7 to the rear stack 20. Therefore, the paper P can be guided to the rear stack 20 so that it can slide down due to its self-weight.

As illustrated in FIGS. 2 to 5, the rear stack 20 has stack frames 21 and 21, a joint 23, a second fabric sheet 31, film materials 40 and 40 . . . , a first fabric fixing shaft 50, and a second fabric fixing shaft 51. A pair of stack frames 21 and 21 are provided in the widthwise direction X of the paper P. The pair of stack frames 21 are swingable about a second pivot shaft 22 provided in the base 9. The joint 23 is connected to the stack frames 21 and 21 at the free ends of the stack frames 21 and 21.

The second fabric sheet 31 is fixed by the first fabric fixing shaft 50 and the second fabric fixing shaft 51 provided in the base 9. Moreover, the front side of the second fabric sheet 31, i.e. the discharge direction upstream end is provided at the tip ends of the front pipes 12 and 12 like the first fabric sheet 30. Meanwhile, the rear side of the second fabric sheet 31, i.e. the downstream end in the discharge direction is provided at the joint 23.

Here, in the position relation between the first fabric fixing shaft 50 and the second fabric fixing shaft 51, the second fabric fixing shaft 51 is vertically lower than the first fabric fixing shaft 50. Therefore, the discharged paper P can easily proceed toward the downstream side in the discharge direction due to the self-weight of the paper P.

Figure 6:
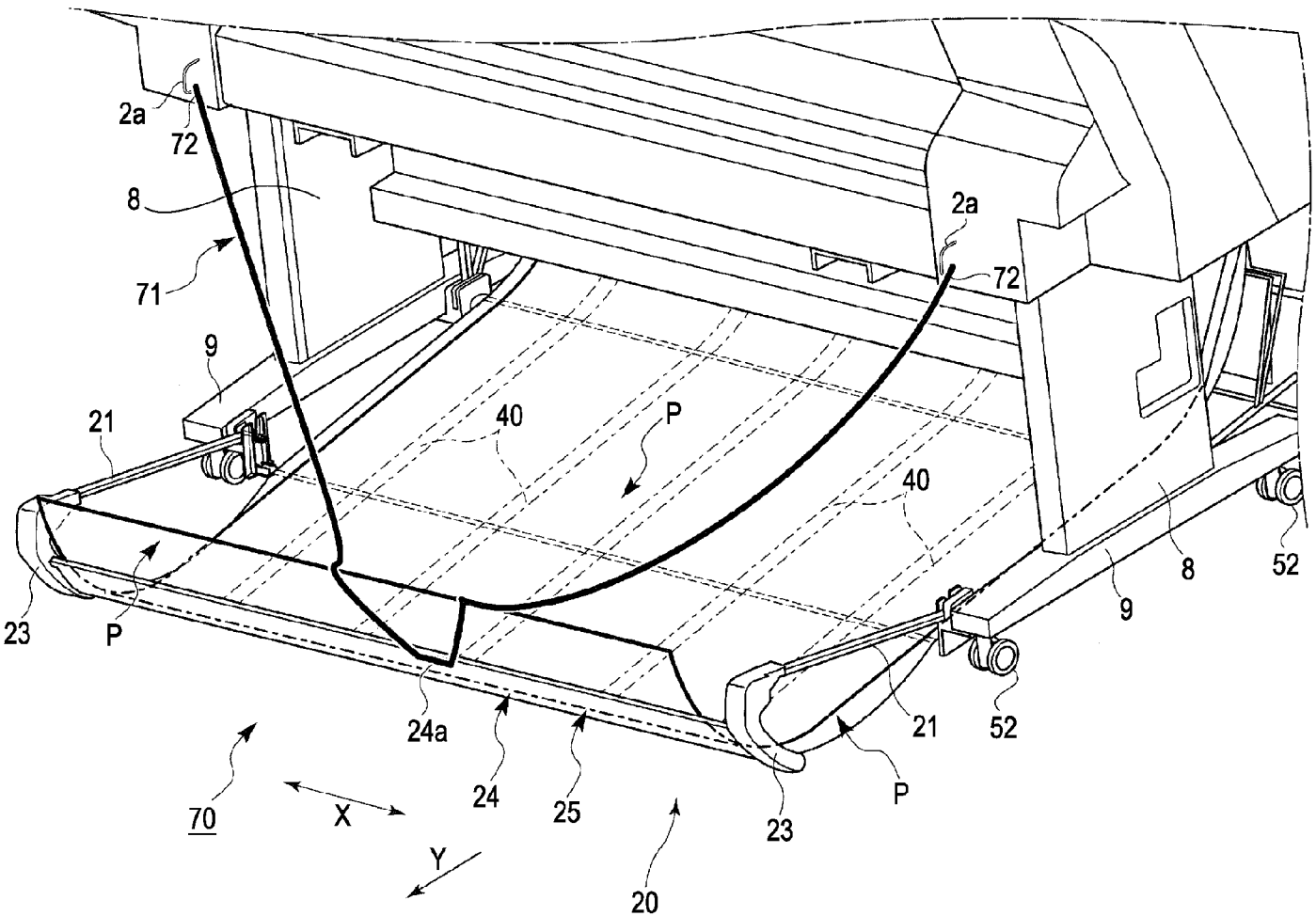
FIG. 6 is a perspective view illustrating a state in which a string according to the invention receives a tip end of a paper.
Figure 7:
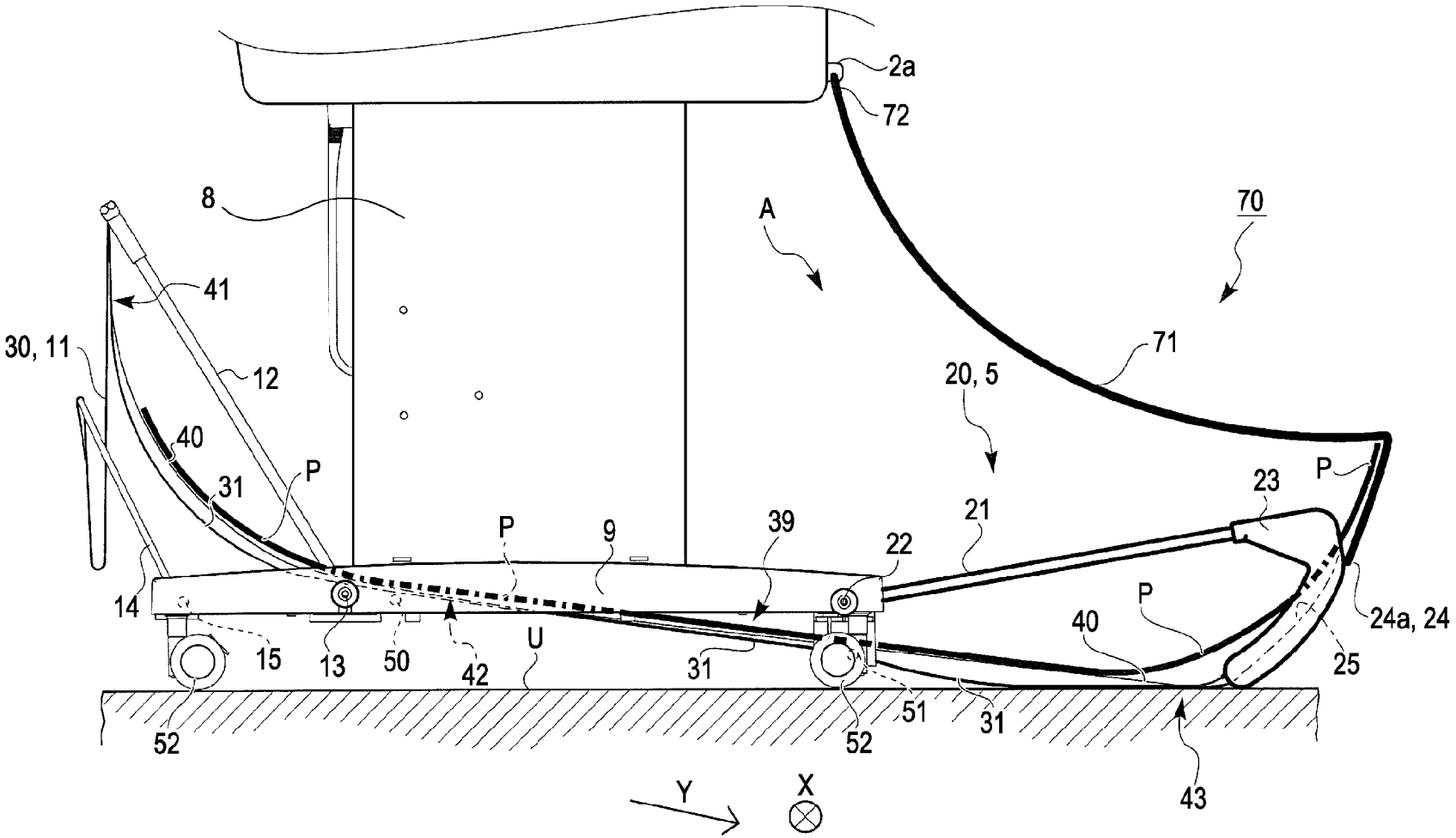
FIG. 7 is a side view illustrating a state in which the string according to the invention receives the tip end of the paper.

The second fabric sheet 31 is fixed by inserting the first fabric fixing shaft 50 and the second fabric fixing shaft 51 into holes formed by winding the second fabric sheet 31 once (refer to FIGS. 6 and 7). That is, some portions of the second fabric sheet 31 are wound around the outer circumferential surface of the first fabric fixing shaft 50 and the second fabric fixing shaft 51 to form the holes, and the first fabric fixing shaft 50 and the second fabric fixing shaft 51 are inserted into the holes.

Moreover, a plurality of film materials 40 and 40 . . . , i.e. low friction members such as plastic members extend in the discharge direction Y on an upper surface of the second fabric sheet 31. In more detail, the film materials 40 and 40 . . . are caught by the second fabric sheet 31 at three sections of first catching portions 41 and 41 . . . , second catching portions 42 and 42 . . . , and third catching portions 43 and 43 . . . .

Therefore, since different diameters R can be drawn when members having different flexibility are bent, the deformation of the members is prevented from being disturbed.

As a result, as illustrated in FIG. 2, the rear stack 20 can be smoothly received. Then, the second fabric sheet 31 is pulled tightly between the second fabric fixing shaft 51 and the joint 23. Therefore, the second fabric sheet 31 has a good appearance. Further, the printer 1 is moved in a received state, the second fabric sheet 31 is prevented from coming into contact with the floor U. Therefore, when the printer 1 is moved, the second fabric sheet 31 is prevented from being soiled.

The opposite ends 72 and 72 of the string 71 engage with a pair of string engaging portions 2*a* and 2*a* provided in the main body 2 respectively. A middle portion 73 of the string 71 is caught by a middle portion 24*a* in the widthwise direction X of the rear stack 20. In more detail, the middle portion 73 of the string 71 is sewn to the rear stack 20. Therefore, even when the engagement of the pair of string engaging portions 2*a* and 2*a* with the string 71 is released for some reason or other, the string 71 is prevented from being lost.

Hereinafter, the operation and effect of the string 71 as the paper projection preventing unit 70 will be described.

Figure 8:
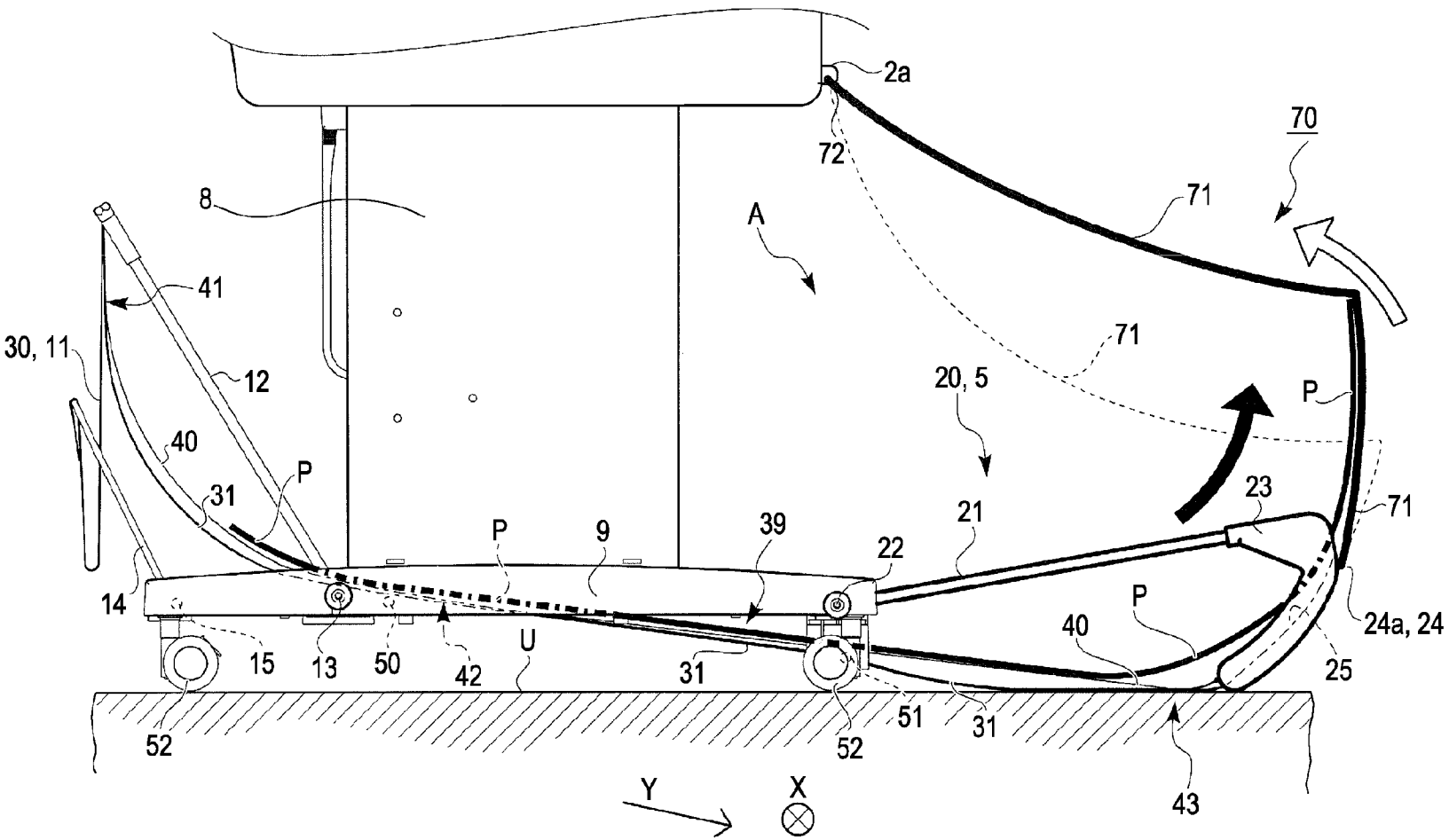
FIG. 8 is a side view illustrating a state in which the string according to the invention receives and guides the tip end of the paper upward.
Figure 9:
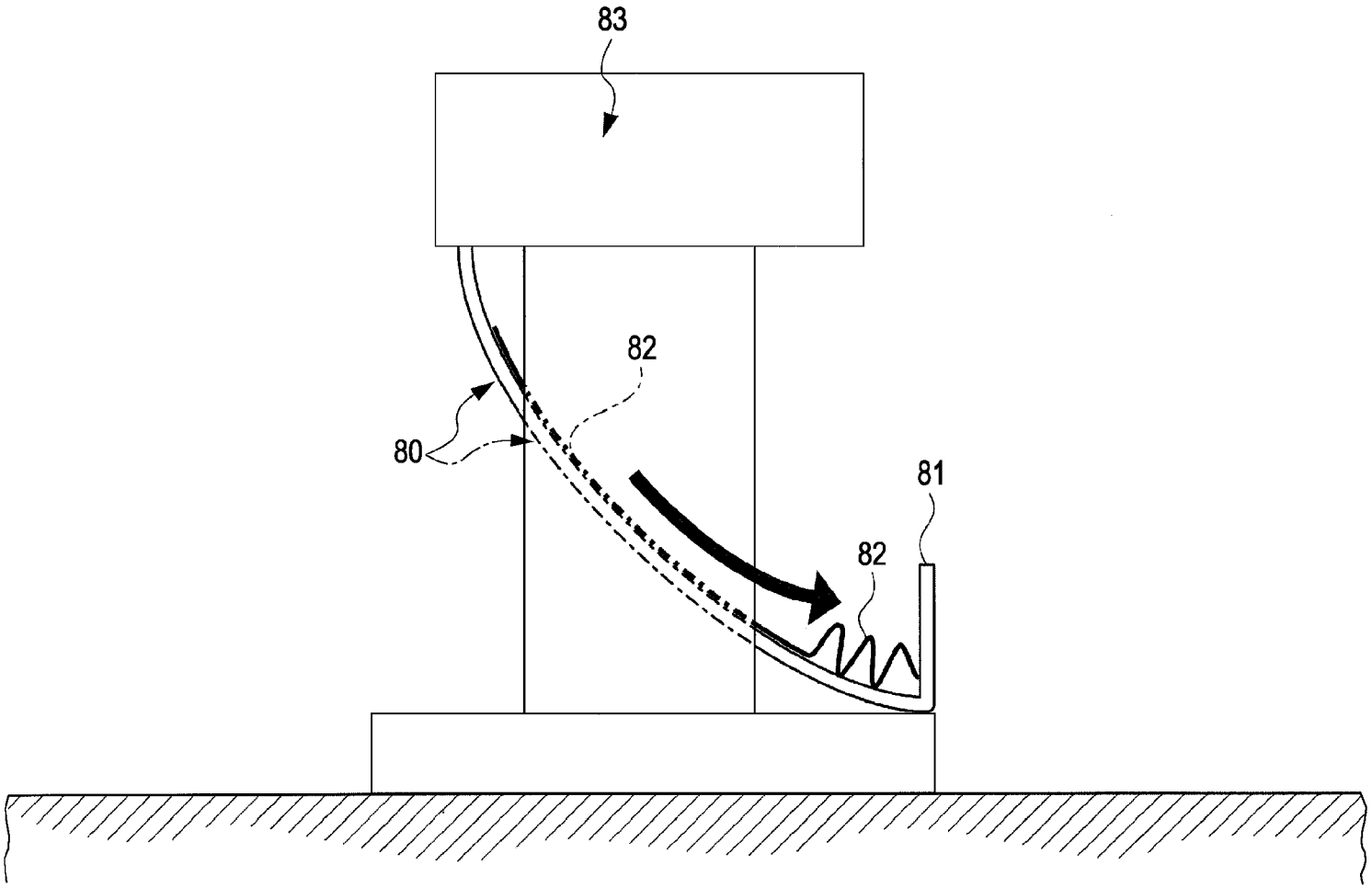
FIG. 9 is a side view schematically illustrating an example of a conventional discharge stacker.

FIG. 6 is a perspective view illustrating a state in which the string according to the invention receives a tip end of a paper. FIG. 7 is a side view illustrating a state in which the string according to the invention receives the tip end of the paper. FIG. 8 is a side view illustrating a state in which the string according to the invention receives and guides the tip end of the paper upward.

As illustrated in FIGS. 6 to 8, when the paper P is discharged to the rear stack 20, the tip end of the paper P is moved toward a first inclined portion 25 provided on the tip end side of the rear stack 20.

Here, the first inclined portion 25 is inclined with respect to the postures of the film materials 40 and 40 . . . between the second catching portions 42 and 42 . . . and the third catching portions 43 and 43 . . . of the rear stack 20. In more detail, the first inclined portion 25 is inclined such that the tip end side of the rear stack 20 is located on the vertically upper side.

Then, if the size of the paper P is B0, the paper P is stopped when the tip end of the paper P is located at the first inclined portion 25.

However, when the size of the paper P is B0+ longer than B0, the tip end of the paper P may be popped out from the first inclined portion 25 to come into contact with the floor U. Even if the size of the paper P is relatively small, the situation is similar when the paper P is discharged from the main body 2, is dropped due to its self-weight to be slid and dropped powerfully onto the film materials 40 and 40 . . . on the second fabric sheet 31 supported by the front pipes 12 and 12, and is discharged powerfully to the rear stack 20. Since the frictional coefficient of the film materials 40 and 40 . . . is small, the tip end of the paper P may be popped out from the rear stack 20 to come into contact with the floor U.

Therefore, the inkjet printer 1 according to the embodiment of the invention includes a paper projection preventing unit 70 that prevents the tip end of the paper P from being popped out from the rear stack 20 and coming into contact with the floor U.

In more detail, the paper projection preventing unit 70 has a string 71. As described above, the opposite ends 72 and 72 of the string 71 engage with the pair of string engaging portions 2*a* and 2*a* provided in the main body 2. A middle portion 73 of the string 71 is caught by a middle portion 24*a* in the widthwise direction X of the stack tip end 24. In other words, the string 71 is connected to the string engaging portions 2*a* and 2*a* and the stack tip end 24 and forms a lateral closed region A as illustrated in FIGS. 7 and 8.

Here, the "lateral closed region" refers to a region whose downstream side with respect to the discharge direction is closed. The string 71 is connected to the string engaging portions 2*a* and 2*a* and the stack tip end 24 between the string engaging portions 2*a* and 2*a* and the stack tip end 24 such that it is loosened so as not to come into contact with the floor U. In more detail, as described below, it is because the string 71 can receive the tip end of the paper P flexibly.

In the rear stack 20, when the tip end of the paper P proceeds from the upstream side to the downstream side in the discharge direction, it ascends the inclination of the first inclined portion 25 and runs off the stack tip end 24. Then, the tip end of the paper P comes into contact with the loosened string 71. When the tip end of the paper P runs off the stack tip end 24 further, the slack of the string 71 is gradually reduced. Then, a force by which the paper P proceeds to run off the stack tip end 24 is converted into a force that moves the string 71 to tighten the string 71.

Then, when the tip end of the paper P proceeds in the direction in which it runs off the stack tip end 24 as shown in FIG. 8, the string 71 guides the tip end of the paper P from the stack tip end 24 toward the string engaging portions 2*a* and 2*a*. That is, the string 71 guides the paper P toward the string engaging portions 2*a* and 2*a* provided on the vertically upper side of the stack tip end 24. The force by which the paper P runs off the stack tip end 24 is absorbed by the string 71 to stop the paper P. That is, the string 71 can flexibly receive the paper P.

Here, the term "flexibly" will be described in detail.

The slack of the loosened string 71 is reduced when the string 71 comes into contact with the tip end of the paper P. Thereafter, the tip end of the paper P draws a laterally curved locus when it proceeds upward from the stack tip end 24 toward the string engaging portions 2*a* and 2*a*. Then, the paper P may be stopped when the kinetic energy of the paper P is converted into potential energy or due to the frictional resistance of the paper P. That is, the paper P is stopped by reducing its speed.

Here, as the slack of the string 71 becomes larger, the curve of the locus drawn by the tip end of the paper P can become smoother. That is, as the slack of the string 71 becomes larger, the paper P can be received by the string 71 more flexibly.

As a result, the tip end of the paper P is prevented from coming into contact with the floor U and being soiled. Further, since the tip end of the paper P is received flexibly, damage to the tip end of the paper P can be reduced as compared with a conventional technology in which the tip end of the paper P comes into contact when it is received.

In particular, when a discharged paper receiving unit 5 is provided below the main body 2, since the paper P powerfully slides down to the rear stack 20 as a discharge stacker due to its own weight, the paper projection preventing unit 70 is effective. The paper P is not limited to a predetermined size such as B0+, and may be a roll paper. In more detail, the situation is similar even when the roll paper powerfully slides down to the rear stack 20 due to the self-weight after it is cut off by a cutter (not shown).

Further, when the film materials 40 and 40 . . . , i.e. low friction members are provided on the rear stack 20 as a discharge stacker, since the tip end of the paper P is apt to run off the stack tip end 24 of the rear stack 20, the paper projection preventing unit 70 is effective.

Moreover, when a downstream side of the second inclined portion 39 in the discharge direction, i.e. a path to the rear stack 20 is inclined downward like a slide, since the tip end of the paper P is apt to run off the stack tip end 24 of the rear stack 20, the paper projection preventing unit 70 is effective.

The first inclined portion 25 is displaced and inclined upward as it goes toward the downstream side in the discharge direction. Accordingly, the tip end of the paper P can have an ascending posture as it runs off the rear stack 20. Therefore, the first inclined portion 25 can assist guiding the tip end of the paper P that has run off the string 71 upward. In other words, the tip end of the paper P can have a smoother locus. As a result, the string 71 can receive the tip end of the paper P more satisfactorily.

Moreover, the string 71 is one string. Therefore, the string 71 can easily constitute the paper projection preventing unit 70. Further, the string 71 is excellent in cost performance.

The opposite ends 72 and 72 of the string 71 engage the pair of string engaging portions 2*a* and 2*a*, and the middle portion 73 of the string 71 is caught by the middle portion 24*a* in the widthwise direction X of the stack tip end 24. That is, the string 71 forms a V-like shape. Therefore, even when the size of the paper P is different, the string 71 comes into contact with the tip end of the paper P to flexibly receive it. Further, since the string 71 can make contact with the tip end of the paper P at two positions, the posture of the paper P is prevented from being unstable. Moreover, since the string 71 has a V-like shape, the string 71 is prevented from obstructing the paper P when the paper P discharged to the rear stack 20 is picked up.

Further, since the string 71 is a flexible member it is prevented from obstructing conversion of the position of the rear stack 20 to the received position of FIG. 2 and the used position of FIG. 3. Then, since the string 71 can be received inside the rear stack 20, it has a good appearance.

Moreover, the provision of the paper projection preventing unit 70 may make the length of the rear stack 20 itself shorter. It is because the tip end of the paper P is prevented from being popped out from the rear stack 20 and coming into contact with the floor U even when the rear stack 20 is made short. As a result, the overall size of the recording apparatus can be made small.

The inkjet printer 1 as a recording apparatus according to an embodiment of the invention includes a recording unit 4 as a recorder that performs a recording operation on a paper P as an example of a sent recording medium, a main body 2 as an apparatus body that has the recording unit 4, a rear stack 20 as a discharge stacker that places the paper P discharged from the main body 2 therein, a string 71 as an example of a flexible member that forms a lateral closed region A by connecting a stack tip end 24 that is a discharge direction downstream end of the rear stack 20 and string engaging portions 2*a* and 2*a* of the main body 2 on the upper side of the stack tip end 24 in the placing direction.

The ink jet printer 1 according to the embodiment of the invention includes a string 71 that connects the stack tip end 24 of the rear stack 20 and the main body 2 on the upper side of the stack tip end 24 in a placing direction in a state in which the string 71 is loosened so as not to come into contact with a floor U on which the ink jet printer 1 is installed.

In the ink jet printer 1 according to the embodiment of the invention, as the paper P is discharged, a tip end of the paper P that has run off the stack tip end 24 of the rear stack 20 comes into contact with the string 71 and is guided toward the main body 2 by the string 71.

In the embodiment of the invention, the rear stack 20 pivots about a second pivot shaft 22 as a pivot shaft provided on the upstream side in the discharge direction of the stack tip end 24 and has a received position as a first position taken during a storage of the recording apparatus and a used position as a second position where the paper P that has been discharged from the main body 2 is placed.

In the embodiment of the invention, the flexible member is a string-like material, i.e. the string 71.

In the embodiment of the invention, opposite ends 72 and 72 of the string 71 engage with the string engaging portions 2*a* and 2*a* of the main body 2 and a middle portion 73 of the string 71 engages with the stack tip end 24 of the rear stack 20 and the middle portion 24*a* in the widthwise direction X.

Moreover, in the embodiment of the invention, the rear stack 20 has a first inclined portion 25 that is inclined so as to displace toward the upper side as it goes from an upstream side to a downstream side at the stack tip end 24.

In the embodiment of the invention, the rear stack 20 is provided at a lower side of the main body 2 in a vertical direction and has a second inclined portion 39 that is inclined so as to displace to a vertically lower side as it goes toward a discharge direction downstream side between the main body 2 and the rear stack 20.

Moreover, in the embodiment of the invention, the second inclined portion 39 has a second fabric sheet 31 as a first sheet-like member and a plurality of film materials 40 as a plurality of second members extending toward the discharge direction Y of the paper P, being disposed in the widthwise direction X of the paper P, and having a frictional coefficient smaller than that of the second fabric sheet 31 in an upper side of a placing direction of the second fabric sheet 31.

It is apparent that the invention is not limited to the above-described embodiment and various modification are possible without departing the scope of the invention claimed in the claims.

What is claimed is:

1. A recording apparatus comprising:

a recording unit that performs a recording operation on a sent recording medium;

a main body that has the recording unit;

a discharge stacker that places the recording medium discharged from the main body therein; and a flexible member that forms a lateral closed region by connecting a downstream end in a discharge direction of the discharge stacker and the main body on the upper side of the downstream end in the discharge direction of the discharge stacker in a placing direction.

2. A recording apparatus comprising:

a recording unit that performs a recording operation on a sent recording medium;

a main body that has the recording unit;

a discharge stacker that places the recording medium discharged from the main body therein; and a flexible member that connects a downstream end in a discharge direction of the discharge stacker and the main body on the upper side of the downstream end in the discharge direction of the discharge stacker in a placing direction in a state in which the flexible member is loosened so as not to come into contact with a surface on which the recording apparatus is installed.

3. A recording apparatus comprising:

a recording unit that performs a recording operation on a sent recording medium;

a main body that has the recording unit;

a discharge stacker that places the recording medium discharged from the main body therein; and a flexible member that connects a downstream end in a discharge direction of the discharge stacker and the main body on the upper side of the downstream end in the discharge direction of the discharge stacker in a placing direction, wherein as the recording medium is discharged, a tip end of the recording medium that has run off the downstream end in the discharge direction of the discharge stacker comes into contact with the flexible member and is guided toward the main body by the flexible member.

4. The recording apparatus according to claim 1, wherein the discharge stacker pivots about a pivot shaft installed on an upstream side of the downstream end in the discharge direction of the discharge stacker and wherein the discharge stacker has a first position taken during a storage of the recording apparatus and a second position where the recording medium that has been discharged from the main body is placed.

5. The recording apparatus according to claim 1, wherein the flexible member is a string-like material.

6. The recording apparatus according to claim 5, wherein opposite ends of the string-like material engage with the main body and a middle portion of the string-like material engages with the downstream end in the discharge direction of the discharge stacker at a widthwise middle portion of the downstream end.

7. The recording apparatus according to claim 1, wherein the discharge stacker has a first inclined portion that is inclined so as to displace toward the upper side along the placing direction as it goes from an upstream side to a downstream side at the downstream end in the discharge direction of the discharge stacker.

8. The recording apparatus according to claim 1, wherein the discharge stacker is provided at a lower side of the main body in a vertical direction and has a second inclined portion that is inclined so as to displace to a vertically lower side as it goes toward a downstream side in the discharge direction of the discharge stacker between the main body and the discharge stacker.

9. The recording apparatus according to claim 8, wherein the second inclined portion has a first sheet-like member and a plurality of second members extending toward the discharge direction of the recording medium, being disposed in the widthwise direction of the recording medium, and having a frictional coefficient smaller than that of the first member in an upper side of a placing direction of the first member.

* * * * *